United States Patent [19]

Esposito

[11] Patent Number: 4,627,822

[45] Date of Patent: Dec. 9, 1986

[54] LOW TEMPERATURE INFLATOR APPARATUS

[75] Inventor: John J. Esposito, Langhorne, Pa.

[73] Assignee: The United States of America as represented by the Secretary of the Navy, Washington, D.C.

[21] Appl. No.: 729,725

[22] Filed: May 20, 1985

[51] Int. Cl.[4] ..... B63C 9/12

[52] U.S. Cl. ..... 441/92

[58] Field of Search ..... 441/30-31, 441/40-41, 92-101; 222/315

[56] References Cited

U.S. PATENT DOCUMENTS

| | | | |
|---|---|---|---|
| 3,059,814 | 10/1962 | Poncel et al. | 441/94 |
| 3,117,424 | 1/1964 | Hebenstreit | 222/3 |
| 3,222,230 | 12/1965 | Hebenstreit et al. | 441/100 |
| 3,269,310 | 8/1966 | Wismar | 441/100 |
| 3,515,518 | 6/1970 | Halstead et al. | 441/98 |
| 3,597,780 | 8/1971 | Coyle | 441/94 |
| 3,833,029 | 9/1974 | Munn | 441/100 |
| 4,097,241 | 6/1978 | Garner et al. | 441/98 |

*Primary Examiner*—Sherman D. Basinger
*Assistant Examiner*—Jesûs D. Sotelo
*Attorney, Agent, or Firm*—Robert F. Beers; Henry Hansen

[57] ABSTRACT

A low temperature inflator assembly for an inflatable life raft or life preserver for ensuring sufficient buoyancy in low ambient temperatures. A $CO_2$ cartridge and a solid pyrotechnic gas generator are positioned side-by-side in a heat transfer housing. A single actuator punctures the cartridge and ignites the generator. Combustion gas from the generator supplies immediate low pressure inflation while heat transferred from the generator to the cartridge accelerates a subsequent high pressure source of $CO_2$. Higher gas capacity and pressure are obtained with no tradeoff of total size compared to the conventional $CO_2$ cartridge inflators.

7 Claims, 3 Drawing Figures

LOW TEMPERATURE INFLATOR APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to inflator apparatus for inflating emergency flotation gear such as life rafts and life jackets; and more particularly to an inflator for flotation gear which may be stored at, and operated in, extremely low temperatures.

Liquid $CO_2$ (carbon dioxide) cartridges have been used for many years as the main source of pressurized gas for inflating various types of inflatable life saving devices such as rafts, vests and jackets. Emergency use of these devices by downed aircrewman has occurred mostly in temperate zones. However, these situations now occur more frequently in the arctic region where temperatures below −20° F. are not uncommon. At these low temperatures, liquid $CO_2$ changes too slowly to the gaseous phase to provide immediate buoyancy. A rapid change is especially needed in a life raft to enable a downed person in frigid water to board as soon as possible. The longer he or she remains exposed to the cold water awaiting the formation of a boardable raft, the more likely hypothermia will set in. Raft inflation time in excess of five minutes has been observed when $CO_2$ cartridges were stored in an aircraft at sub-zero temperatures and then activated in water at 32° F. Consequently, lives have been needlessly lost.

In lieu of liquid $CO_2$ cartridges, solid pyrotechnic inflators have been tried which generate gas from a compacted solid material, but the gas of combustion does not attain the pressure level needed for buoyancy of inflatable gear.

SUMMARY OF THE INVENTION

Accordingly, it is an object of the present invention to provide a rapid inflator for inflatable life preserving gear which will operate effectively over a wide temperature range including extremely low temperatures. Another object is to provide an inflator which is relatively small, compact, and suitable for use with inflatable life rafts, life jackets, and similar gear. Still another object is to provide an inflator in which the combined advantages of a liquid $CO_2$ cartridge and a solid pyrotechnic gas generator are fully utilized. A further object is to provide a simple and reliable inflator which can be manufactured at low cost, and which can be easily retrofitted into existing life preserving equipment.

Briefly, these and other objects of the invention are accomplished by a liquid $CO_2$ cartridge and a solid pyrotechnic gas generator, positioned side-by-side in a heat exchanger and operated by a single actuator, for providing the amount of gas needed to effectively inflate a life raft, jacket, or the like. In operation, the actuator punctures the cartridge and ignites the generator. Combustion gas from the generator will begin immediate inflation of the inflatable gear, while heat developed by the generator is transferred to the liquid $CO_2$ for accelerating the venting of high pressure $CO_2$ gas to the gear.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
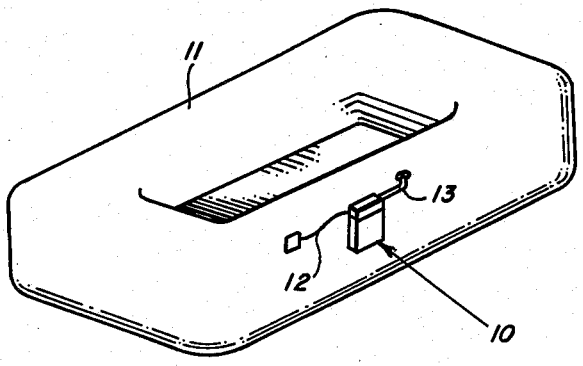
FIG. 1 is a schematic representation of a low temperature inflator according to the invention as applied to an inflatable life raft.

Referring now to the drawing wherein like characters designate like or corresponding parts throughout the several views, an inflator 10 is secured to a life raft 11 in a position readily accessible to the downed person or for automatic operation. A lanyard 12, pulled automatically during a deployment sequence, or manually by the wearer, activates the inflator to permit gas to flow from inflator 10 through an inflation tube 13 into the raft.

Figure 2:
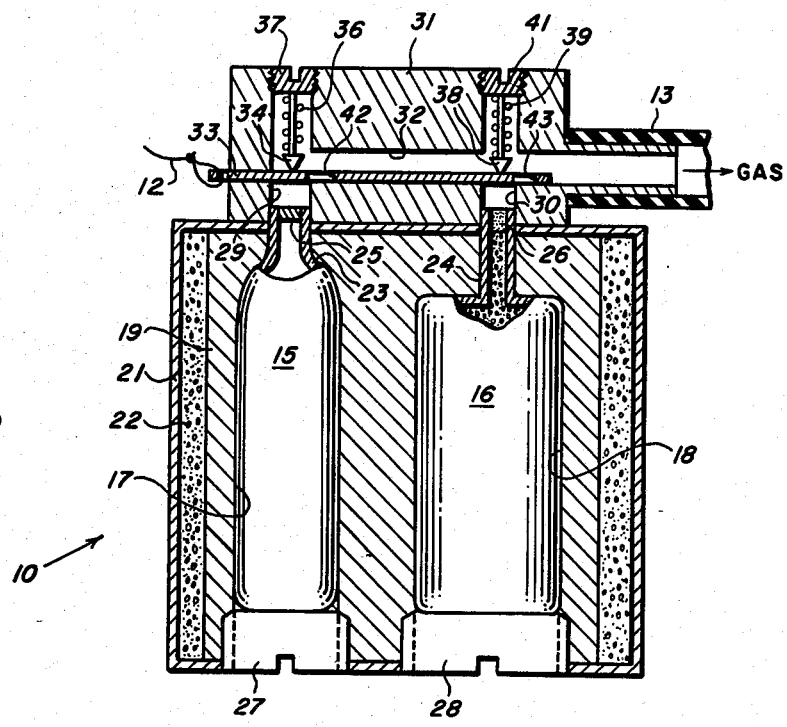
FIG. 2 is an enlarged cross-sectional view of the inflator of FIG. 1.

As seen in FIG. 2, inflator 10 includes a liquid $CO_2$ cartridge 15 and solid pyrotechnic gas generator 16, both of conventional design, positoned side-by-side in contiguous recesses 17 and 18 of a heat exchange core 19 preferrably fabricated of a solid heat-conductive material such as aluminum.

Core 19 is enclosed in an outer casing 21 which is lined with an insulating jacket 22 such as, a heat resistant rigid foam, a phenolic impregnated paper, or other low heat transfer material capable of withstanding high temperatures in the order of 450°-500° F. Nozzles 23 and 24 at one end of cartridge 15 and generator 16, respectivley, include a puncturable seal 25 and primer 26 which extend through the core 19 and casing 21. Threaded inserts 27 and 28 in casing 21 and core 19 abut the other ends of the cartridge 15 and generator 16 to secure them in place.

Nozzles 23 and 24 register with inlet ports 29 and 30, respectively, of a manifold 31 mounted on casing 21. A passageway 32 between the inlet ports communicates with inflation tube 13. A release plate 33 slideable along the length of passageway 32 occludes the openings to ports 29 and 30. The lanyard 12 is connected at one end of plate 33 which extends from the manifold 31. A lance 34 aligned opposite of port 29 is urged against release plate 33 by a compression spring 36 positioned between lance 34 and a threaded access plug 37 in manifold 31. Similarly, a firing pin 38 aligned opposite of port 30 is urged against release plate 33 by compression spring 39 positioned between pin 38 and a threaded access plug 41 in manifold 31. A pair of escapement holes 42 and 43 in plate 33, equally offset from ports 29 and 30, permit lance 34 and pin 38 to puncture seal 25 and strike primer 26, respectively, when plate 33, pulled by lanyard 12, aligns holes 42 and 43 with ports 29 and 30.

Operation of inflator 10 should now be apparent. Automatic or manual pulling of lanyard 12 causes release plate 33 to slide until escapement holes 42 and 43 align with ports 29 and 30. Lance 34 and pin 38 are thereby released under the force of springs 36 and 39 puncturing seal 25 to release the liquid $CO_2$ and detonating primer 26 to generate their respective gas. At very low temperatures, the liquid $CO_2$ changes to a gas phase too slowly to be useful during initial inflation; however, the combustion gas produced more quickly by generator serves for initial inflation. As generator 16 continues to produce gas, the heat generated during combustion is transferred through core 19 to cartridge 15 raising its temperature, thereby increasing the rate at which the liquid $CO_2$ changes into a high pressure gas suitable for full inflation of the inflatable gear.

Figure 3:
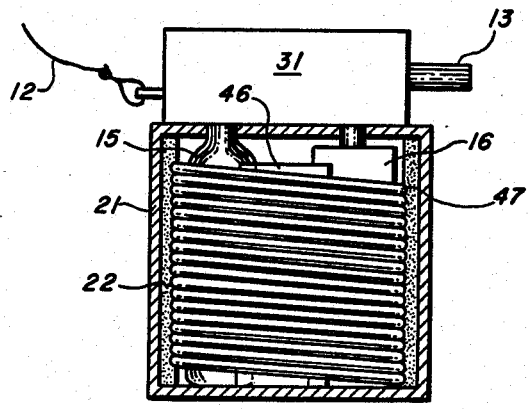
FIG. 3 is another embodiment of a low temperature inflator according to the invention.

FIG. 3 represents an alternate embodiment for transferring the heat of generator 16. The cartridge 15 and generator 16 are contiguously retained against a spacer core 46 by a winding 47, each being of heat conductive materials such as aluminum and copper wire, respectively. All other elements are substantially the same as in the configuration of FIG. 2.

Some of the many advantages and new features of the invention should now be apparent. Rapid and effective inflation of an inflatable gear is insured over a wide temperature range, particularly at extremely cold temperatures. Rafts, for instance, may be inflated in frigid arctic waters in relatively short time with sufficient buoyancy to permit early boarding by a downed person. The overall size of the inflator is compatible with prior art systems used in similar applications such as in life jackets and life vests.

It will be understood that various changes in the details, steps and arrangement of parts, which have been herein described and illustrated in order to explain the nature of the invention, may be made by those skilled in the art within the principle and scope of the invention as expressed in the appended claims.

What is claimed is:

1. A low temperature inflator apparatus for an inflatable device comprising, in combination:

first means containing a liquified gas;

second means containing a combustible solid;

heat transfer means contiguous with said first means and said second means for transferring to said first means heat generated by combustion of said solid;

actuator means operatively connected to said first and second means for concomitant actuation of said first and second means and formed to conduct the gases therefrom to the inflatable device.

2. An apparatus according to claim 1 wherein said actuator means comprises:

a manifold having inlet ports communicating with said first and second means;

vent means aligned with said inlet port associated with said first means for venting said liquified gas;

firing means aligned with said inlet port associated with said second means for firing said solid; and release means for restraining said vent means and said firing means and for selectively releasing and permitting venting and firing said first and second means, respectively.

3. Apparatus according to claim 2 wherein said first and second means each include:

force exerting means urging said first and second means into said inlet ports for venting and firing, respectively.

4. Apparatus according to claim 2 wherein:

said release means includes a slidable member having escapement holes equally offset from said inlet ports for restraining said vent and firing means in a first position and for releasing said vent and firing means in a second position.

5. Apparatus according to claim 4 wherein:

said release means includes a lanyard formed to be externally operated.

6. A low temperature inflator apparatus for an inflatable device comprising, in combination:

a liquid gas cartridge having nozzle seal;

a pyrotechnic gas generator having a nozzle primer;

heat exchanger means contiguously connecting said cartridge and generator in close proximity to each other for transferring heat produced by said generator to said cartridge; and actuator means operatively connected to said cartridge and generator for concomitantly puncturing said seal and igniting said primer, and formed to transfer gases to the inflatable device.

7. Apparatus according to claim 6 wherein said actuator means comprises:

a manifold having inlet ports communicating with said seal and said primer and an outlet port;

release means slidable in said manifold and having escapement holes equally offset from said inlet ports;

a lance aligned with said inlet port associated with said seal for puncturing said seal;

a firing pin aligned with said inlet port associated with said nozzle primer for detonating said primer; and springs operatively connected to said manifold for urging said lance into said seal and said pin against said primer when said escapement holes are aligned with said inlet ports.

* * * * *